US008001655B2

(12) United States Patent
Wang

(10) Patent No.: US 8,001,655 B2
(45) Date of Patent: Aug. 23, 2011

(54) LUGGAGE HANDLE WHOSE PULL BAR WILL NOT BE RELEASED SUDDENLY DUE TO AN ACCIDENTAL SHOCK OR COLLISION

(76) Inventor: Chien-Shan Wang, Miaoli (TW)

( * ) Notice: Subject to any disclaimer, the term of this patent is extended or adjusted under 35 U.S.C. 154(b) by 390 days.

(21) Appl. No.: 12/372,086

(22) Filed: Feb. 17, 2009

(65) Prior Publication Data

US 2010/0205779 A1 Aug. 19, 2010

(51) Int. Cl.
*A45C 3/00* (2006.01)

(52) U.S. Cl. ..... 16/405; 16/113.1; 16/429; 190/115

(58) Field of Classification Search ..... 16/110.1, 16/113.1, 114.1, 405, 429, 444, 446; 190/115, 190/18 A; 220/757, 762; 280/37
See application file for complete search history.

(56) References Cited

U.S. PATENT DOCUMENTS

| | | | | |
|---|---|---|---|---|
| 5,943,936 | A * | 8/1999 | Deliman et al. | 190/115 |
| 6,141,828 | A * | 11/2000 | Kuo | 16/113.1 |
| 6,148,477 | A * | 11/2000 | Cheng | 16/113.1 |
| 6,202,254 | B1 * | 3/2001 | Ezer | 16/113.1 |
| 6,934,997 | B2 * | 8/2005 | Lau | 16/114.1 |
| 6,978,514 | B2 * | 12/2005 | Kuo et al. | 16/113.1 |
| 7,266,863 | B2 * | 9/2007 | Lu | 16/113.1 |
| 2008/0078053 | A1 * | 4/2008 | Lu | 16/113.1 |
| 2009/0107788 | A1 * | 4/2009 | Lin | 190/115 |

* cited by examiner

*Primary Examiner* — William L. Miller
(74) *Attorney, Agent, or Firm* — Alan Kamrath; Kamrath & Associates PA

(57) ABSTRACT

A luggage handle includes a support unit, a control unit and an operation unit. The support unit includes an outer tube having at least one locking hole. The control unit includes a first casing, a second casing, a slide, a push spring, a push shank, an elastic member, a weight and a restoring spring. Thus, when the luggage handle is subjected to a larger shock, the weight is moved downward to move its stop block to abut the limit block of the slide to prevent the locking stub of the slide from being detached from the locking hole of the outer tube and to prevent the pull bar and the inner tube of the operation unit from being moved outwardly from the support seat of the support unit.

18 Claims, 6 Drawing Sheets

LUGGAGE HANDLE WHOSE PULL BAR WILL NOT BE RELEASED SUDDENLY DUE TO AN ACCIDENTAL SHOCK OR COLLISION

BACKGROUND OF THE INVENTION

1. Field of the Invention

The present invention relates to a handle assembly and, more particularly, to a retractable luggage handle.

2. Description of the Related Art

A conventional luggage handle comprises a support unit, a control unit and an operation unit. The support unit includes an outer tube having a side provided with at least one locking hole, and a support seat mounted on an upper end of the outer tube. The control unit includes a housing movably mounted in the outer tube of the support unit, a slide movably mounted in the housing and having a first end provided with a locking stub detachably locked in the locking hole of the outer tube and a second end provided with a driven portion, a push spring biased between the second end of the slide and the housing, a push shank movably mounted on the housing and having a lower end provided with a drive portion detachably pressing the driven portion of the slide and an upper end provided with a pressing portion, and an elastic member biased between the pressing portion of the push shank and the housing. The operation unit includes an inner tube movably mounted in the outer tube of the support unit and having a lower end connected with the control unit, a pull bar movably mounted on the support seat of the support unit and having a lower end connected with an upper end of the inner tube, a drive rod movably mounted in the inner tube and having a lower end abutting the pressing portion of the push shank to move the push shank of the control unit toward the slide of the control unit and an upper end provided with a thrust portion movably mounted on the lower end of the pull bar, and a push button movably mounted on the lower end of the pull bar and abutting the thrust portion of the drive rod to push the drive rod toward the push shank of the control unit.

In operation, the elastic member pushes the pressing portion of the push shank upward relative to the housing so that the drive portion of the push shank is moved upward to detach from the driven portion of the slide. At this time, the push spring pushes the slide toward the locking hole of the outer tube so that the locking stub of the slide is locked in the locking hole of the outer tube to lock the control unit onto the outer tube of the support unit and to lock the operation unit onto the outer tube of the support unit.

When the push button is pressed by a user, the thrust portion of the drive rod is moved downward to push the drive rod which pushes the pressing portion of the push shank to move the push shank of the control unit toward the slide of the control unit, so that the drive portion of the push shank is movable to press the driven portion of the slide to drive the slide outwardly relative to the outer tube and to detach the locking stub of the slide from the locking hole of the outer tube so as to unlock the control unit from the outer tube of the support unit and to unlock the operation unit from the outer tube of the support unit. Thus, the operation unit is movable freely relative to the support unit so that the pull bar and the inner tube of the operation unit can be pulled outwardly from the support seat of the support unit.

However, when the luggage handle is thrown during transportation, the luggage handle is easily subjected to a shock due to a hit or collision, so that the drive rod is easily moved downward due to the shock to push the push shank toward the slide and to detach the locking stub of the slide from the locking hole of the outer tube. Thus, the pull bar and the inner tube of the operation unit can be moved outwardly from the support seat of the support unit so that the pull bar and the inner tube are easily deformed or worn out due to a larger hit or collision.

BRIEF SUMMARY OF THE INVENTION

In accordance with the present invention, there is provided a luggage handle, comprising a support unit, a control unit and an operation unit. The support unit includes an outer tube having a side provided with at least one locking hole. The operation unit is mounted on the support unit. The control unit is mounted in the outer tube of the support unit and includes a first casing movably mounted in the outer tube of the support unit and having a side provided with a transverse slideway, a second casing mounted on the first casing, a slide movably mounted in the slideway of the first casing and having a first end provided with a limit block which has a locking stub detachably locked in the locking hole of the outer tube and a second end provided with a driven portion, a push spring biased between the slide and the second casing, a push shank movably mounted on the first casing and having a lower end provided with a drive portion detachably pressing the driven portion of the slide and an upper end provided with an enlarged pressing portion, an elastic member biased between the pressing portion of the push shank and the first casing, a weight movably mounted on the first casing and having a lower end provided with a stop block that is movable to abut the limit block of the slide to prevent the locking stub of the slide from being detached from the locking hole of the outer tube, and a restoring spring biased between the first casing and the lower end of the weight to drive the stop block of the weight to detach from the limit block of the slide.

The primary objective of the present invention is to provide a luggage handle whose pull bar will not be released suddenly due to an accidental shock, hit or collision.

Another objective of the present invention is to provide a luggage handle, wherein when the luggage handle is subjected to a larger shock or impact due to hit of an external force, the weight is moved downward, and the stop block of the weight is also moved downward to abut the limit block of the slide to prevent the locking stub of the slide from being detached from the locking hole of the outer tube and to prevent the pull bar and the inner tube of the operation unit from being moved outwardly from the support seat of the support unit so as to prevent the pull bar and the inner tube from being deformed or worn out due to a larger hit or collision.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
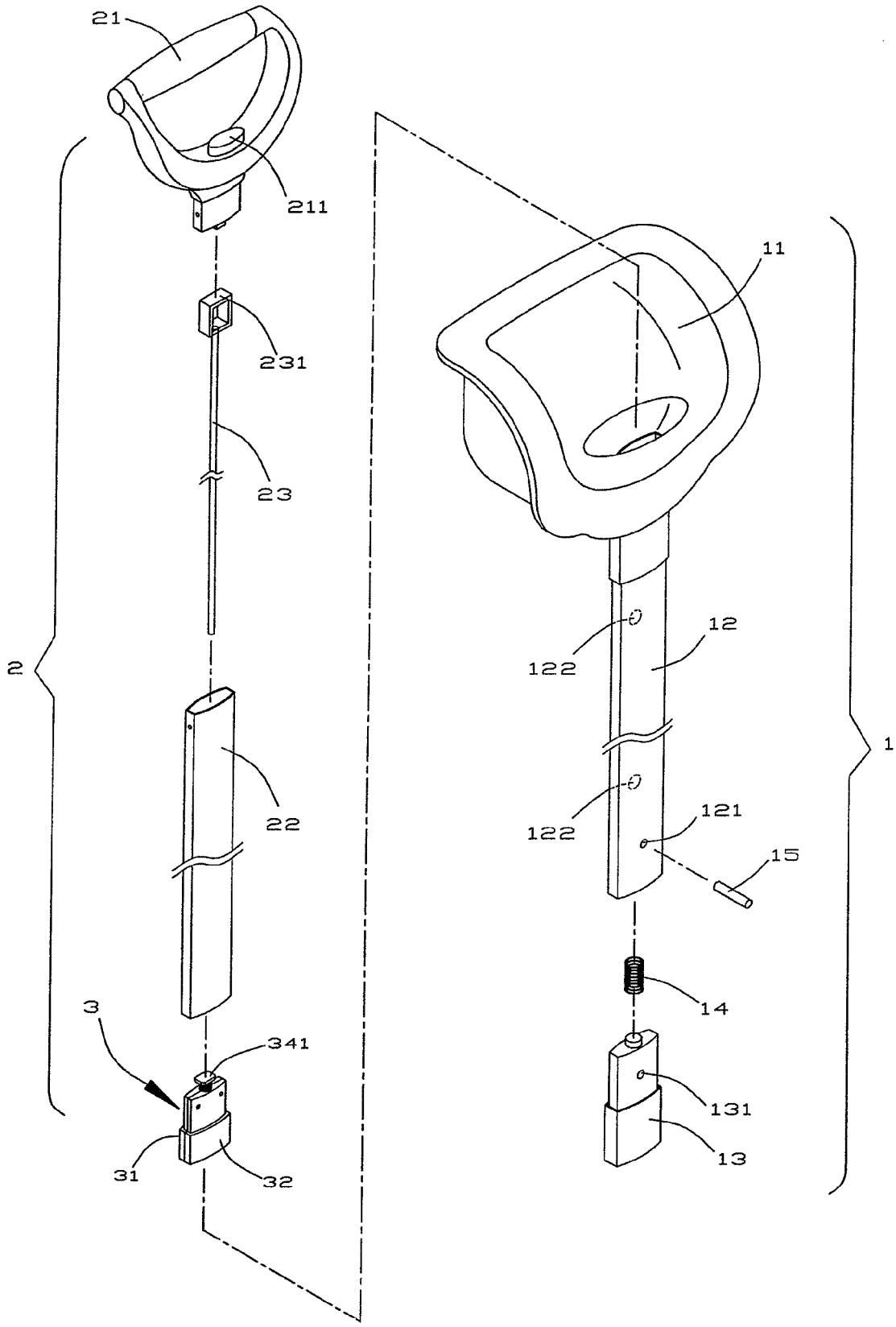
FIG. 1 is a partially exploded perspective view of a luggage handle in accordance with the preferred embodiment of the present invention.
Figure 2:
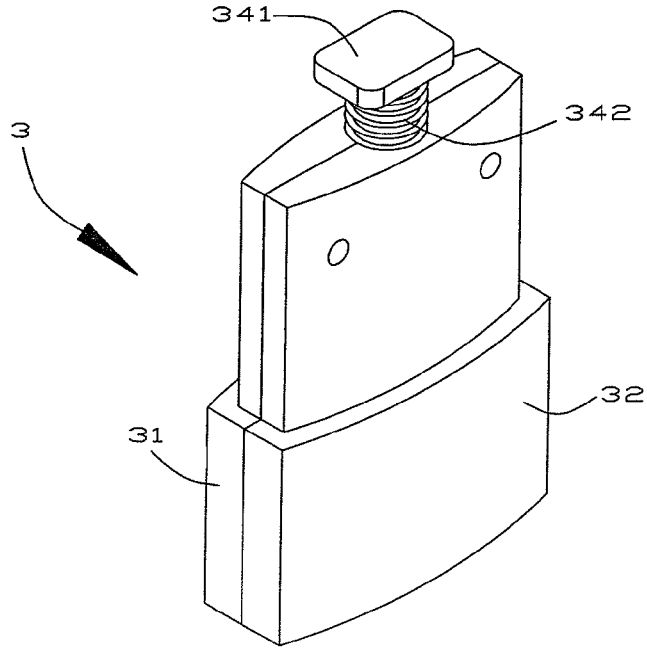
FIG. 2 is a perspective view of a control unit of the luggage handle as shown in FIG. 1.
Figure 3:
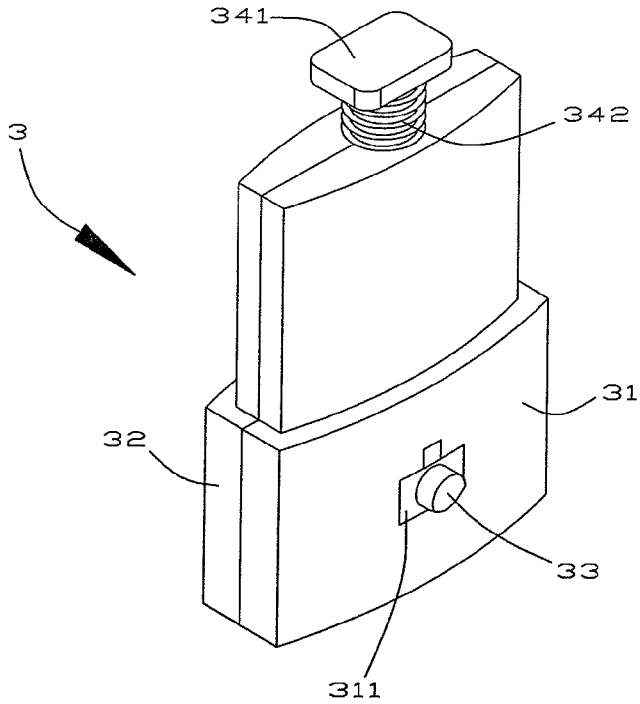
FIG. 3 is another perspective view of the control unit of the luggage handle as shown in FIG. 1.
Figure 4:
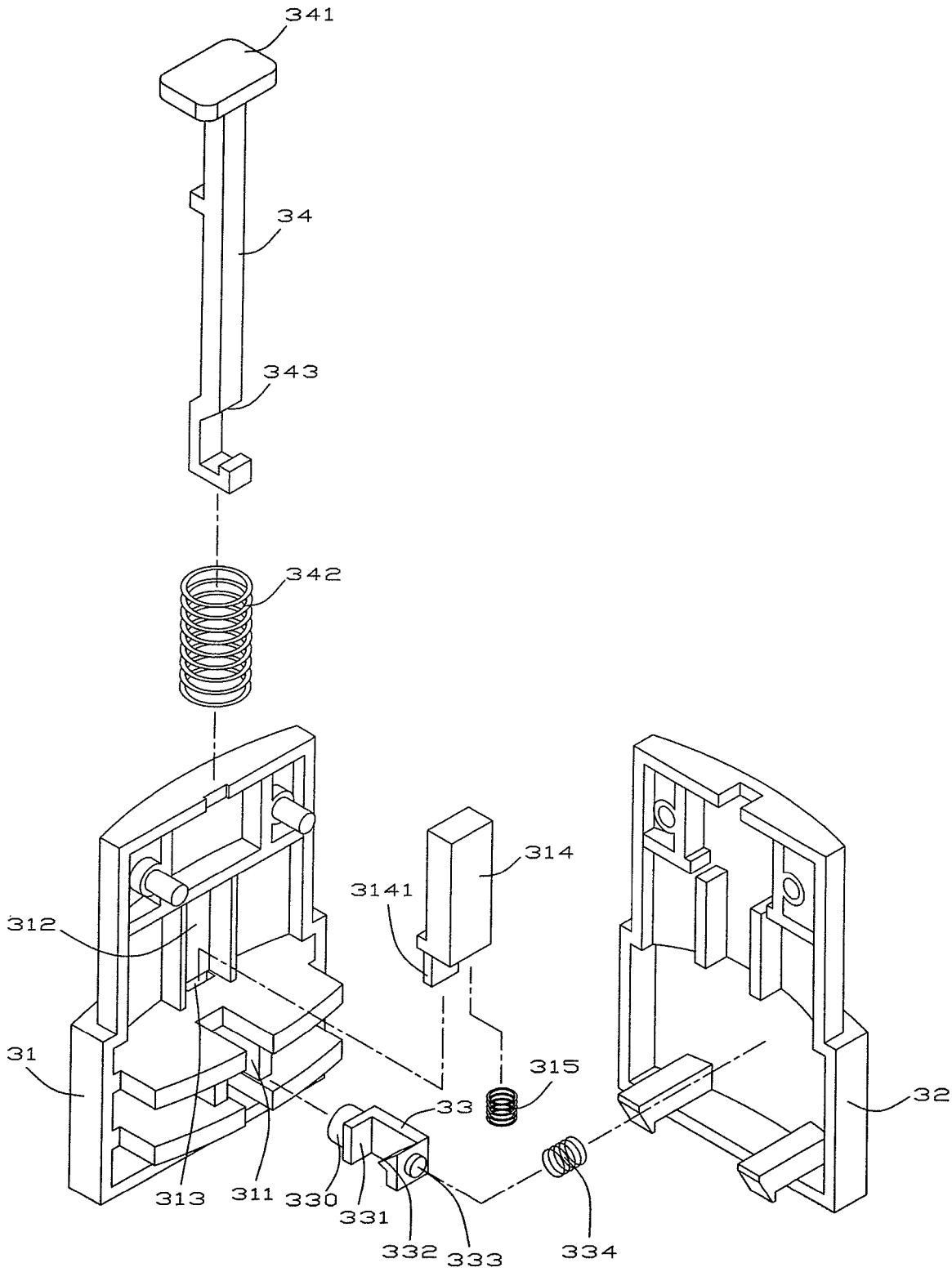
FIG. 4 is an exploded perspective view of the control unit of the luggage handle as shown in FIG. 2.

Referring to the drawings and initially to FIGS. 1-5, a luggage handle in accordance with the preferred embodiment of the present invention comprises a support unit 1, a control unit 3 and an operation unit 2.

The support unit 1 includes an outer tube 12 having a side provided with at least one locking hole 122, a support seat 11 mounted on an upper end of the outer tube 12, a base 13 mounted on a lower end of the outer tube 12, a spring 14 biased between the base 13 and a lower end of the control unit 3 to push the control unit 3 upward relative to the outer tube 12, and a rivet 15 extending through the lower end of the outer tube 12 and the base 13 to attach the base 13 to the lower end of the outer tube 12. The lower end of the outer tube 12 is provided with a through hole 121 to allow passage of the rivet 15, and the base 13 is also provided with a through hole 131 to allow passage of the rivet 15. The spring 14 is located in the outer tube 12 and has a lower end mounted on an upper end of the base 13.

The control unit 3 is mounted in the outer tube 12 of the support unit 1 and includes a first casing 31 movably mounted in the outer tube 12 of the support unit 1 and having a side provided with a transverse slideway 311, a second casing 32 mounted on the first casing 31, a slide 33 movably mounted in the slideway 311 of the first casing 31 and having a first end provided with a limit block 331 which has a locking stub 330 detachably locked in the locking hole 122 of the outer tube 12 and a second end provided with a driven portion 332, a push spring 334 biased between the slide 33 and the second casing 32, a push shank 34 movably mounted on the first casing 31 and having a lower end provided with a drive portion 343 detachably pressing the driven portion 332 of the slide 33 and an upper end provided with an enlarged pressing portion 341, an elastic member 342 biased between the pressing portion 341 of the push shank 34 and the first casing 31, a weight 314 movably mounted on the first casing 31 and having a lower end provided with a stop block 3141 that is movable to abut the limit block 331 of the slide 33 to prevent the locking stub 330 of the slide 33 from being detached from the locking hole 122 of the outer tube 12, and a restoring spring 315 biased between the first casing 31 and the lower end of the weight 314 to drive the stop block 3141 of the weight 314 to detach from the limit block 331 of the slide 33.

The first casing 31 has an inner portion provided with an upright sliding slot 312 in which the weight 314 is movable. The sliding slot 312 of the first casing 31 is located above the slideway 311 of the first casing 31 and has a bottom provided with an upright sliding channel 313 in which the stop block 3141 of the weight 314 is movable. The sliding channel 313 of the first casing 31 is connected to the slideway 311 of the first casing 31. The slideway 311 of the first casing 31 is movable to align with the locking hole 122 of the outer tube 12. The second casing 32 is combined with the first casing 31 to move in concert with the first casing 31.

The slide 33 is movably mounted between the first casing 31 and the second casing 32. The slide 33 has a substantially U-shaped cross-sectional profile. The limit block 331 and the driven portion 332 of the slide 33 are located opposite to each other. The driven portion 332 of the slide 33 has a tapered shape. The second end of the slide 33 has a first side provided with the driven portion 332 facing the limit block 331 and a second side provided with a mounting stub 333 for mounting the push spring 334.

The weight 314 is movably mounted between the first casing 31 and the second casing 32 and is movable in a direction perpendicular to that of the slide 33.

The push spring 334 is biased between the second end of the slide 33 and the second casing 32 to push the locking stub 330 and the limit block 331 of the slide 33 toward the locking hole 122 of the outer tube 12.

The drive portion 343 of the push shank 34 has a tapered shape and is located between the limit block 331 and the driven portion 332 of the slide 33. The drive portion 343 of the push shank 34 is movably mounted between the first casing 31 and the second casing 32 and is movable to press the driven portion 332 of the slide 33 to drive the slide 33 outwardly relative to the outer tube 12 and to detach the locking stub 330 of the slide 33 from the locking hole 122 of the outer tube 12. The pressing portion 341 of the push shank 34 protrudes outwardly from the first casing 31 and the second casing 32.

The operation unit 2 is mounted on the support unit 1 and includes an inner tube 22 movably mounted in the outer tube 12 of the support unit 1 and having a lower end connected with an upper end of the control unit 3 to move in concert with the control unit 3, a pull bar 21 movably mounted on the support seat 11 of the support unit 1 and having a lower end connected with an upper end of the inner tube 22 to move the inner tube 22, a drive rod 23 movably mounted in the inner tube 22 and having a lower end abutting the pressing portion 341 of the push shank 34 to move the push shank 34 of the control unit 3 toward the slide 33 of the control unit 3 and an upper end provided with a thrust portion 231 movably mounted on the lower end of the pull bar 21, and a protruding push button 211 movably mounted on the lower end of the pull bar 21 and abutting the thrust portion 231 of the drive rod 23 to push the drive rod 23 toward the push shank 34 of the control unit 3.

Figure 5:
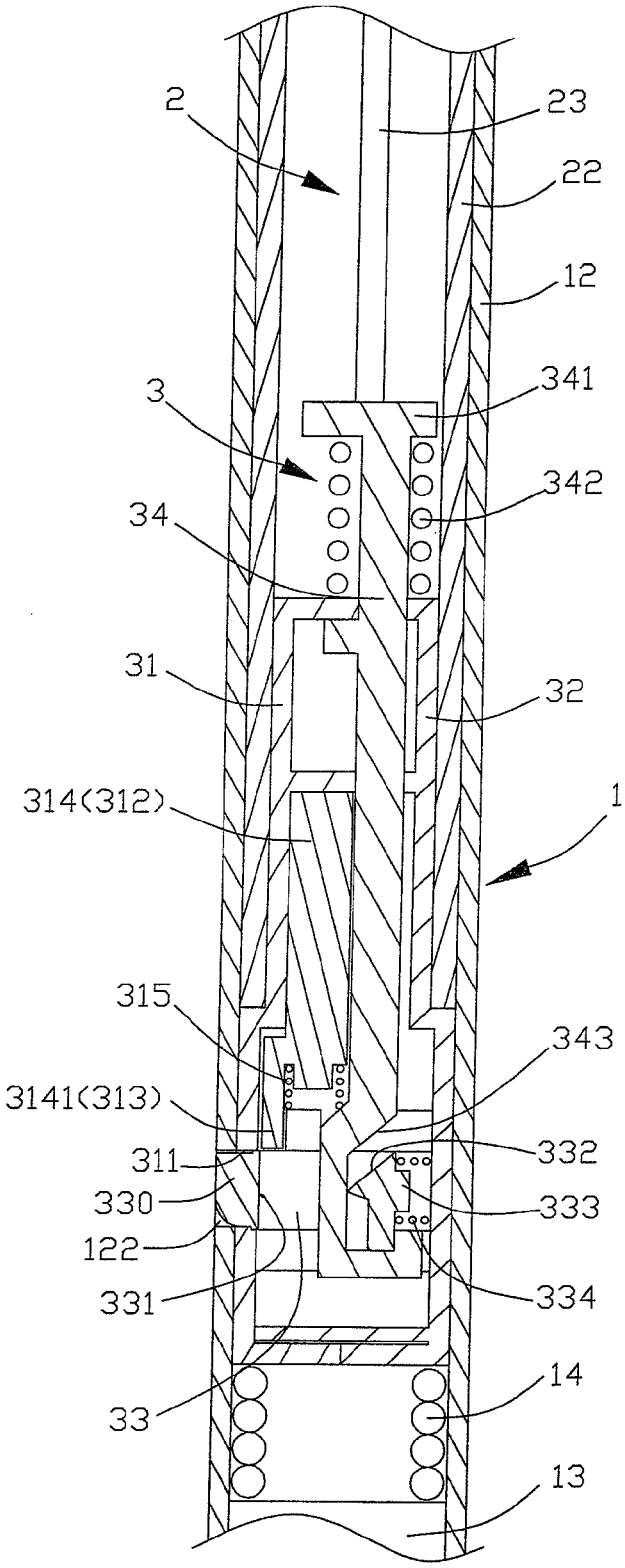
FIG. 5 is a side cross-sectional assembly view of the luggage handle as shown in FIG. 1.
Figure 6:
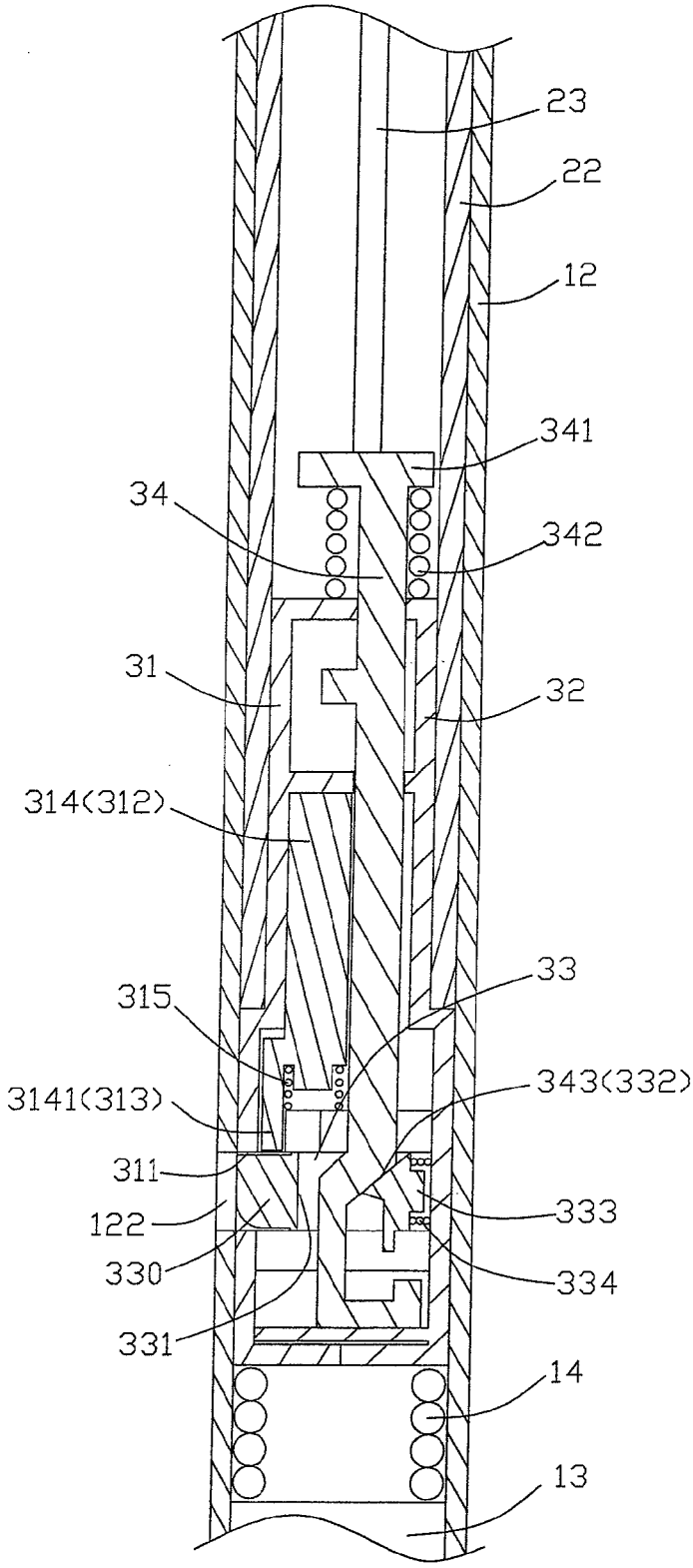
FIG. 6 is a schematic operational view of the luggage handle as shown in FIG. 5.

In operation, referring to FIGS. 5 and 6 with reference to FIGS. 1-4, the elastic member 342 pushes the pressing portion 341 of the push shank 34 upward relative to the first casing 31 so that the drive portion 343 of the push shank 34 is moved upward to detach from the driven portion 332 of the slide 33 as shown in FIG. 5. At this time, the push spring 334 pushes the slide 33 toward the locking hole 122 of the outer tube 12 so that the locking stub 330 of the slide 33 is locked in the locking hole 122 of the outer tube 12 as shown in FIG. 5 to lock the control unit 3 onto the outer tube 12 of the support unit 1 and to lock the operation unit 2 onto the outer tube 12 of the support unit 1.

When the push button 211 is pressed by a user, the thrust portion 231 of the drive rod 23 is moved downward to push the drive rod 23 which pushes the pressing portion 341 of the push shank 34 to move the push shank 34 of the control unit 3 toward the slide 33 of the control unit 3, so that the drive portion 343 of the push shank 34 is movable to press the driven portion 332 of the slide 33 to drive the slide 33 outwardly relative to the outer tube 12 and to detach the locking stub 330 of the slide 33 from the locking hole 122 of the outer tube 12 as shown in FIG. 6 so as to unlock the control unit 3 from the outer tube 12 of the support unit 1 and to unlock the operation unit 2 from the outer tube 12 of the support unit 1. Thus, the operation unit 2 is movable freely relative to the support unit 1 so that the pull bar 21 and the inner tube 22 of the operation unit 2 can be pulled outwardly from the support seat 11 of the support unit 1. At this time, the spring 14 pushes the control unit 3 upward relative to the outer tube 12 to facilitate movement of the operation unit 2.

Again referring to FIG. 5, the push spring 334 pushes the slide 33 toward the locking hole 122 of the outer tube 12 so that the locking stub 330 of the slide 33 is locked in the locking hole 122 of the outer tube 12 as shown in FIG. 5 to lock the control unit 3 onto the outer tube 12 of the support unit 1 and to lock the operation unit 2 onto the outer tube 12 of the support unit 1. Thus, the operation unit 2 is retracted into the support unit 1.

Figure 7:
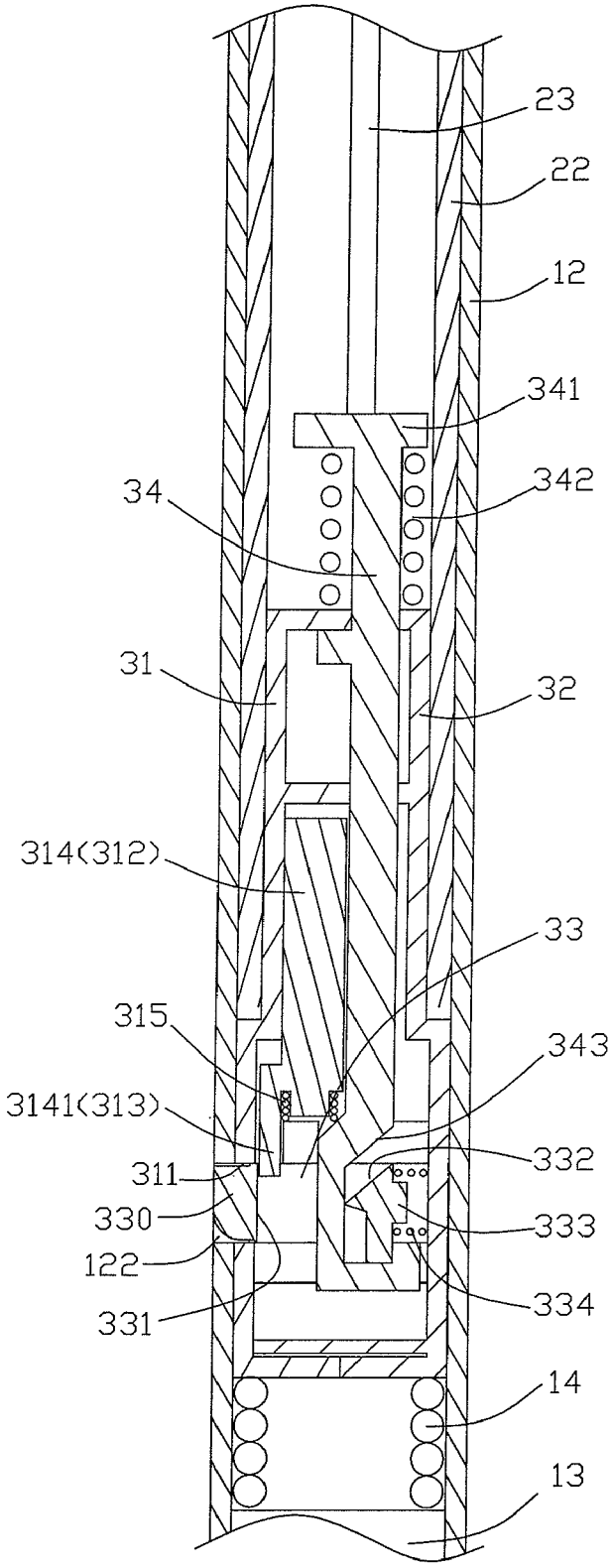
FIG. 7 is a schematic operational view of the luggage handle as shown in FIG. 5.

Referring to FIGS. 5 and 7, when the luggage handle is thrown during transportation, the luggage handle is easily subjected to a shock due to a hit or collision, so that the drive rod 23 is easily moved downward due to the shock to push the push shank 34 toward the slide 33 and to detach the locking stub 330 of the slide 33 from the locking hole 122 of the outer tube 12. At this time, when the luggage handle is subjected to the shock due to a hit or collision, the weight 314 is also subjected to a downward force instantaneously, so that the weight 314 is moved downward toward the slide 33 to compress the restoring spring 315, and the stop block 3141 of the weight 314 is also moved downward to abut the limit block 331 of the slide 33 as shown in FIG. 7 so as to prevent the locking stub 330 of the slide 33 from being detached from the locking hole 122 of the outer tube 12 and to prevent the pull bar 21 and the inner tube 22 of the operation unit 2 from being moved outwardly from the support seat 11 of the support unit 1.

After the downward force applied on the weight 314 is removed, the limit block 331 of the slide 33 is pushed by the elastic action of the push spring 334 to detach from the stop block 3141 of the weight 314, and the weight 314 is pushed upward by the restoring force of the restoring spring 315, so that the stop block 3141 of the weight 314 is moved upward to detach from the limit block 331 of the slide 33 so as to allow movement of the slide 33.

Accordingly, when the luggage handle is subjected to a larger shock or impact due to hit of an external force, the weight 314 is moved downward, and the stop block 3141 of the weight 314 is also moved downward to abut the limit block 331 of the slide 33 to prevent the locking stub 330 of the slide 33 from being detached from the locking hole 122 of the outer tube 12 and to prevent the pull bar 21 and the inner tube 22 of the operation unit 2 from being moved outwardly from the support seat 11 of the support unit 1 so as to prevent the pull bar 21 and the inner tube 22 from being deformed or worn out due to a larger hit or collision.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A luggage handle, comprising:

a support unit including:

an outer tube having a side provided with at least one locking hole;

a control unit mounted in the outer tube of the support unit and including:

a first casing movably mounted in the outer tube of the support unit and having a side provided with a transverse slideway;

a second casing mounted on the first casing;

a slide movably mounted in the slideway of the first casing and having a first end provided with a limit block which has a locking stub detachably locked in the locking hole of the outer tube and a second end provided with a driven portion;

a push spring biased between the slide and the second casing;

a push shank movably mounted on the first casing and having a lower end provided with a drive portion detachably pressing the driven portion of the slide and an upper end provided with an enlarged pressing portion;

an elastic member biased between the pressing portion of the push shank and the first casing;

a weight movably mounted on the first casing and having a lower end provided with a stop block that is movable to abut the limit block of the slide to prevent the locking stub of the slide from being detached from the locking hole of the outer tube;

a restoring spring biased between the first casing and the lower end of the weight to drive the stop block of the weight to detach from the limit block of the slide.

2. The luggage handle of claim 1, wherein the first casing has an inner portion provided with an upright sliding slot in which the weight is movable.

3. The luggage handle of claim 2, wherein the sliding slot of the first casing is located above the slideway of the first casing.

4. The luggage handle of claim 2, wherein the sliding slot of the first casing has a bottom provided with an upright sliding channel in which the stop block of the weight is movable.

5. The luggage handle of claim 4, wherein the sliding channel of the first casing is connected to the slideway of the first casing.

6. The luggage handle of claim 1, wherein the slideway of the first casing is movable to align with the locking hole of the outer tube.

7. The luggage handle of claim 1, wherein the second casing is combined with the first casing to move in concert with the first casing.

8. The luggage handle of claim 1, wherein the slide is movably mounted between the first casing and the second casing.

9. The luggage handle of claim 1, wherein the slide has a substantially U-shaped cross-sectional profile.

10. The luggage handle of claim 1, wherein the limit block and the driven portion of the slide are located opposite to each other.

11. The luggage handle of claim 1, wherein the second end of the slide has a first side provided with the driven portion facing the limit block and a second side provided with a mounting stub for mounting the push spring;

the push spring is biased between the second end of the slide and the second casing to push the locking stub and the limit block of the slide toward the locking hole of the outer tube.

12. The luggage handle of claim 1, wherein the weight is movably mounted between the first casing and the second casing and is movable in a direction perpendicular to that of the slide.

13. The luggage handle of claim 1, wherein the drive portion of the push shank is located between the limit block and the driven portion of the slide.

14. The luggage handle of claim 1, wherein the driven portion of the slide has a tapered shape;

the drive portion of the push shank has a tapered shape.

15. The luggage handle of claim 1, wherein the drive portion of the push shank is movably mounted between the first casing and the second casing.

16. The luggage handle of claim 1, wherein the drive portion of the push shank is movable to press the driven portion of the slide to drive the slide outwardly relative to the outer tube and to detach the locking stub of the slide from the locking hole of the outer tube.

17. The luggage handle of claim 1, wherein the pressing portion of the push shank protrudes outwardly from the first casing and the second casing.

18. The luggage handle of claim 1, further comprising:

an operation unit mounted on the support unit and including:

an inner tube movably mounted in the outer tube of the support unit and having a lower end connected with an upper end of the control unit to move in concert with the control unit;

a pull bar movably mounted on the support unit and having a lower end connected with an upper end of the inner tube to move the inner tube;

a drive rod movably mounted in the inner tube and having a lower end abutting the pressing portion of the push shank to move the push shank of the control unit toward the slide of the control unit and an upper end provided with a thrust portion movably mounted on the lower end of the pull bar;

a protruding push button movably mounted on the lower end of the pull bar and abutting the thrust portion of the drive rod to push the drive rod toward the push shank of the control unit.

* * * * *